US006913658B2

(12) United States Patent
Delaunay et al.

(10) Patent No.: US 6,913,658 B2
(45) Date of Patent: Jul. 5, 2005

(54) PROCESS FOR THE HOT-DIP GALVANIZING OF METAL STRIP MADE OF HIGH-STRENGTH STEEL

(75) Inventors: Didier Delaunay, Breuillet (FR); François Mignard, Mennecy (FR)

(73) Assignee: Stein Heurtey, Ris Orangis (FR)

( * ) Notice: Subject to any disclaimer, the term of this patent is extended or adjusted under 35 U.S.C. 154(b) by 8 days.

(21) Appl. No.: 10/216,794

(22) Filed: Aug. 13, 2002

(65) Prior Publication Data

US 2003/0047255 A1 Mar. 13, 2003

(30) Foreign Application Priority Data

Aug. 21, 2001 (FR) ..... 01 10957

(51) Int. Cl.[7] ..... C21D 9/00
(52) U.S. Cl. ..... 148/625; 148/579
(58) Field of Search ..... 148/533, 559, 148/625, 660, 661

(56) References Cited

U.S. PATENT DOCUMENTS 6,635,313 B2 * 10/2003 Pradnam et al. ..... 148/540

* cited by examiner

*Primary Examiner*—Deborah Yee
(74) *Attorney, Agent, or Firm*—Connolly Bove Lodge & Hutz LLP

(57) ABSTRACT

A process is disclosed for the continuous thermochemical treatment of metal strip. It is useful with steel strip, of the oxidation-reduction type, in which the strip moves through a furnace in a protective atmosphere. The strip passes through at least one partial or total isolation device positioned within one or more sections of the furnace. The strip is heated in this isolation device in atmospheres having a dew point tailored to each strip according to the specific composition of the steel so that the atmosphere is oxidizing in the case of certain addition elements, but remains reducing in the case of iron.

2 Claims, No Drawings

PROCESS FOR THE HOT-DIP GALVANIZING OF METAL STRIP MADE OF HIGH-STRENGTH STEEL

FIELD OF INVENTION

The present invention relates to the hot-dip galvanizing of steel strip with improved mechanical properties in a vertical furnace. It relates more particularly to a process for carrying out chemical treatments on the strip, simultaneously with the annealing heat treatment or not, such as oxidation-reduction, etc., in atmospheres different from those of the usual sections of the furnace.

BACKGROUND OF THE INVENTION

Continuous galvanizing furnaces according to the current state of the art are conventionally composed of several zones through which the strip passes in succession:

- in certain cases, a bare-flame preheating zone, that is to say one provided with burners which develop their flame directly in the chamber. This zone conventionally allows the strip to be raised from room temperature to a temperature of about 650 to 700° C.;
- a radiant-tube heating zone in which the temperature of the strip is raised to about 700–900° C. This heating zone is placed in a reducing atmosphere so as to make it possible to reduce the oxides formed at the surface of the strip, particularly iron oxides, and in all cases not to create any oxide if there had been none previously;
- a holding zone in which the strip remains at a hold temperature for a time defined by the type of thermal cycle to be produced; and
- one or more cooling zones with controlled cooling rates depending on the type of thermal cycle to be produced. This cooling is carried out until a temperature close to that of the zinc bath, typically 460° C., is achieved.

It has been found that in the galvanizing furnaces according to the prior art, the strip runs through a reducing atmosphere from the inlet right to the outlet of the furnace or, if a bare-flame preheating zone exists, from the outlet of the latter to the outlet of the furnace. The reducing atmosphere is therefore maintained in the furnace at the latest after the outlet of the preheat, i.e. conventionally at a strip temperature of 650 to 700° C. The object of this process is to limit the formation of oxides, mainly iron oxides, on the surface of the strip and to reduce them if any exist or if any is formed in the preheat, so as to allow good bonding of the zinc to the surface of the strip in order to obtain a high-quality galvanized product.

The residence of the strip in this reducing atmosphere must take place under sufficient conditions (temperature, residence time and dew point of the atmosphere in the furnace) in order for the strip to undergo cleaning therein compatible with good quality of the subsequent coating, in particular good quality of zinc adhesion.

Current developments in steels aimed at increasing their mechanical strength result in an increase in the content of alloying elements such as Si, Cr, Mn, etc.

It should be pointed out these new addition elements form oxides that are more stable than iron oxides contained in the structure of the strip. These elements are therefore hungry for oxygen, thereby causing them firstly to be oxidized on the surface of the strip where oxygen is present, even in a low concentration. Since these oxides have consumed the Si, Cr and similar atoms available on the surface, these elements are present in lower concentration thereon. To compensate for this decrease in concentration, the neighbouring Si, Cr or similar atoms will therefore migrate by diffusion from the interior towards the surface, thereby feeding the oxidation reaction. This migration is thermally activated, that is to say accelerated by time and above all by temperature. Consequently, it does not take place in the bare-flame preheat section, since, although the atmosphere is rich in oxygen, the strip remains therein for too short a time at high temperature because of the high heating rate. On the other hand, the diffusion of oxidizable atoms will become substantial in the heating and holding sections as the strip there is hotter, reaching its maximum temperature with longer residence times.

In the reduction section of the furnace, the iron oxides, which are more easily reducible, will be removed. The more stable Si and similar oxides will be more difficult to reduce and will remain, forming a continuous or discontinuous film which acts as an obstacle to good adhesion of the zinc coating.

Existing furnaces are therefore not suited to galvanizing the new high-strength steels because of their richness in oxidizable elements such as Si, Cr, etc. These steels must be galvanized:

- either cold, that is to say electrolytically. This solution allows the desired grade to be used, but is much more expensive to implement;
- or hot, but in this case it is necessary either for the steel to be rapidly (quench) cooled or for its grade to be refined.

Quenching the steel allows the concentration of addition elements to be limited therein, but requires rapid cooling to be carried out after annealing. This cooling allows the formation of multiphase structures which provide the desired hardening properties. However, this technique is still little used.

BRIEF DESCRIPTION OF INVENTION

The invention aims to solve the technical problem explained above by providing a process which allows steels of grades having very high contents of hardening elements to be hot-dip galvanized in furnaces of conventional construction.

The process forming the subject-matter of this invention makes it possible to limit, or even prevent, the formation of oxidized deposits of the hardening metallic addition elements such as, for example, Si, Cr, etc., on the surface of the strip, which deposits form a continuous or discontinuous film countering the adhesion of the zinc coating to the surface of the sheet.

DETAILED DESCRIPTION OF INVENTION

Consequently, this invention relates to a process for the continuous thermochemical treatment of metal strip, of the oxidation-reduction type, in which the strip moves through a furnace in a protective atmosphere, characterized in that the strip passes through at least one partial or total isolation device positioned within at least one section of the furnace, or between two sections, the strip being heated in this isolation device in atmospheres having a dew point tailored to each strip according to the specific composition of the steel and to the thermal cycle applied.

Thus, it will be understood that the process forming the subject-matter of the invention consists mainly of allowing the strip to be heated in atmospheres having dew points which differ, depending on the different temperature ranges, from those known in the prior art, and in particular dew points greater than the usual values, by virtue of isolation devices.

This is because, when the dew point is increased, that is to say the oxygen concentration is increased, the diffusion of oxygen towards the interior of the metal will be promoted by the defects and above all by the grain boundaries. The oxygen will therefore oxidize all the Si or similar atoms within the metal. There will therefore no longer be enough Si or the like available to migrate towards the surface and feed the surface oxidation, the more so as the rate of oxygen diffusion via the grain boundaries is more rapid than the diffusion of the oxidizable atoms in the metal. Moreover, this internal oxidation will block the diffusion of these atoms towards the surface, thereby further limiting the quantity of these oxides formed.

The implementation of the process according to the invention consists in allowing the dew point of this atmosphere in the heating chamber to be accurately controlled so that this atmosphere is oxidizing in the case of the targeted elements but remains reducing in the case of iron, which must not undergo oxidation. The downstream section of the furnace—the end of the hold and the cooling—will remain reducing in order to reduce the iron oxides which could possibly have been formed in the section having a high dew point, which will not reverse the process of internal oxidation of the metallic additives of the steel, since the oxides formed from these additives are more stable than the iron oxides.

According to the invention, the dew point of the atmosphere may be modified according to the thermal cycle, that is to say according to the temperature of the section of the furnace and to the residence time of the strip in this section, in order to incorporate the thickness variations of the strip.

The process forming the subject-matter of the invention is therefore aimed at being able to confine a controlled atmosphere whose dew point is above that used in the furnaces according to the prior art, so as to be less reducing, this being so in one section of the high-temperature furnace of a conventional galvanizing line.

The process is implemented by the installation of atmosphere separation devices between the various sections of the furnace, which installation makes it possible:

- to prevent oxidation of the iron and therefore guarantee adhesion;
- to tailor the chemical composition of the atmosphere desired; and
- to develop the internal oxidation of the addition elements before they are able to diffuse to the surface and be oxidized thereon.

It will of course be understood that this invention is not limited to the methods of implementation described here, rather it encompasses all the variants thereof.

What is claimed is:

1. An oxidation-reduction process for the continuous thermochemical treatment of steel strip, comprising the steps:

moving the strip through a furnace; passing the strip through at least one isolated section of the furnace;

heating the strip in the isolated section;

creating a protective atmosphere in the isolated section and having a preselected variable dew point tailored to the composition of each strip;

the dew point causing oxidation of predetermined alloy elements internally below the surface of the strip while simultaneously avoiding surface oxidation of iron; wherein the dew point promotes the diffusion of oxygen towards the interior of the steel for oxidizing the predetermined alloy elements.

2. A process according to claim 1, wherein the dew point of the atmosphere is selected according to a thermal cycle of the furnace, the temperature of the isolated section, and to a residence time of the strip in the isolated section, in order to accommodate thickness variations of the strip.

* * * * *